United States Patent [19]

Szedressy

[11] Patent Number: 4,741,531

[45] Date of Patent: May 3, 1988

[54] STRINGING SYSTEM FOR A RACKET AND METHOD FOR STRINGING A RACKET

[76] Inventor: Yvan Szedressy, 5, rue Ami Argand, 1290 Versoix, Switzerland

[21] Appl. No.: 832,686

[22] Filed: Feb. 25, 1986

Related U.S. Application Data

[63] Continuation of Ser. No. 634,395, Jul. 25, 1984, abandoned.

[30] Foreign Application Priority Data

Jul. 26, 1983 [CH] Switzerland ..... 4071/83

[51] Int. Cl.[4] ..... A63B 51/04; A63B 49/00

[52] U.S. Cl. ..... 273/73 D

[58] Field of Search ..... 273/73 R, 73 C, 73 D, 273/73 E; 24/115 M, 136 R, 136 L, 115 R, 132 WL, 326, 327, 328, 437, 483, 484, 25, 194; 43/44.91, 44.93

[56] References Cited

U.S. PATENT DOCUMENTS

| | | | |
|---|---|---|---|
| 1,526,734 | 2/1925 | Andrews et al. | 273/73 D |
| 1,562,568 | 11/1925 | Linquist | 24/136 R |
| 1,621,746 | 3/1927 | Morten | 273/73 D |
| 4,118,029 | 10/1978 | Septier | 273/73 D |
| 4,320,900 | 3/1982 | Blackburne | 273/73 D |

FOREIGN PATENT DOCUMENTS

| | | | |
|---|---|---|---|
| 406943 | 10/1970 | Australia | 24/115 M |
| 636655 | 2/1962 | Canada | 24/115 M |
| 2928748 | 1/1981 | Fed. Rep. of Germany | 273/73 D |
| 1196771 | 5/1959 | France | 273/73 D |
| 498430 | 1/1939 | United Kingdom | 273/73 D |
| 887526 | 1/1962 | United Kingdom | 273/73 D |

*Primary Examiner*—Matthew L. Schneider

*Attorney, Agent, or Firm*—Wegner & Bretschneider

[57] ABSTRACT

A stringing system for a racket consisting of two elements, a prewoven net of individual strings and a two piece fixing device, acting as a string clamp in the string hole of a racket frame under the string's own tension. A first member of the fixing device is tubular in shape and is designed to extend through the interior of the racket frame hole. Its upper portion extends outward from the frame hole and has a slot which separates it into two half shells. A second member of the fixing device is placed over the frame hole and is located entirely exteriorly of the hole. The exterior surface of the second member is adapted to the profile of the racket frame. During stringing of the racket, the first member is placed inside the second member and into the frame hole. The string is passed through the hole in the first member, such that when the first member slides into the second member, its two half shells are pressed together around the string to hold the string in place when under tension.

6 Claims, 2 Drawing Sheets

STRINGING SYSTEM FOR A RACKET AND METHOD FOR STRINGING A RACKET

This application is a continuation of application Ser. No. 634,395 filed July 25, 1984, now abandoned.

BACKGROUND OF THE INVENTION

This invention concerns a system for the stringing of rackets, for example tennis rackets, by means of a prewoven net and a system of reusable fixing devices.

Until now rackets have been strung by using one or two strings, one for the horizontal stringing, the other for the vertical stringing. Each string has to go through a certain number of holes in the frame of the racket. At each passage the string needs to be temporarily tensioned and held in place, in order to facilitate the passing of the string in the reverse direction through the next hole. Once the stringing process has been carried out in one direction, the strings in the other direction have to be interwoven with the strings already in place. This traditional method is tedious and requires a great deal of manual work.

SUMMARY OF THE INVENTION

It is the object of this invention to provide an improved system for stringing rackets that is fast and lends itself to at least partial automation.

The present invention consists of two complementary inventive elements:

A prewoven net of individual strings, which can be produced industrially, allowing to rapidly string a racket without having to manually interweave a long piece of string.

A fixing device for racket strings consisting of two pieces one sliding within the other, fitting into the holes of the frame and clamping the string under the string's own tension, thus permitting to tension each string individually. This device besides being usable in conjuction with the prewoven net can also be used to string a racket with individual strings.

Compared to the system known under the name "Stringlock HEAD", the inventive fixing device has the advantage of being usable with any type racket equipped with individual holes for each string. In addition, it is reusable and allows easy application. Existing rackets made out of different materials, e.g. wood or synthetic fibres etc., can also be equipped with the fixing device without need for any adjustment.

BRIEF DESCRIPTION OF THE DRAWINGS

The present invention has as its objective to facilitate the stringing of rackets and is described by the characterizing parts of claim 1, 7 and 10. The invention is best understood by means of the figures which represent:

DESCRIPTION OF THE PREFERRED EMBODIMENTS

These drawings represent only the preferred form of the invention and are only to be considered as examples.

Figure 1:
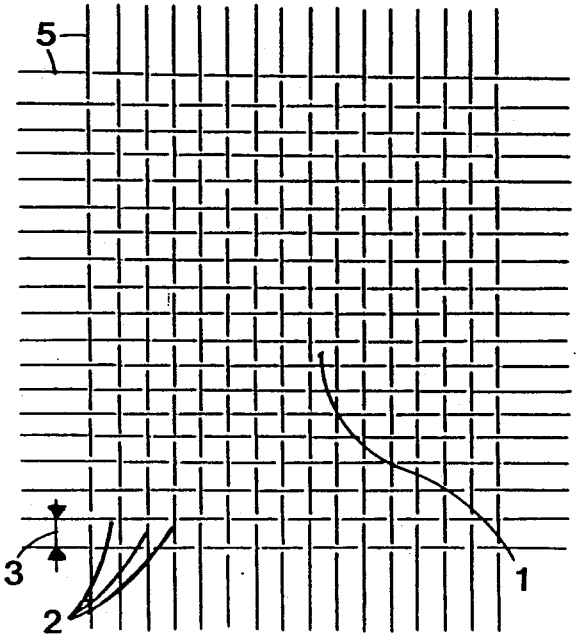
FIG. 1: a net of prewoven strings according to the invention.

FIG. 1 represents an example of a net according to the invention. The strings 2 are interwoven at right angles. The distance 3 between the strings adapts itself to the distance between the holes in the racket at the moment of tensioning.

Figure 2:
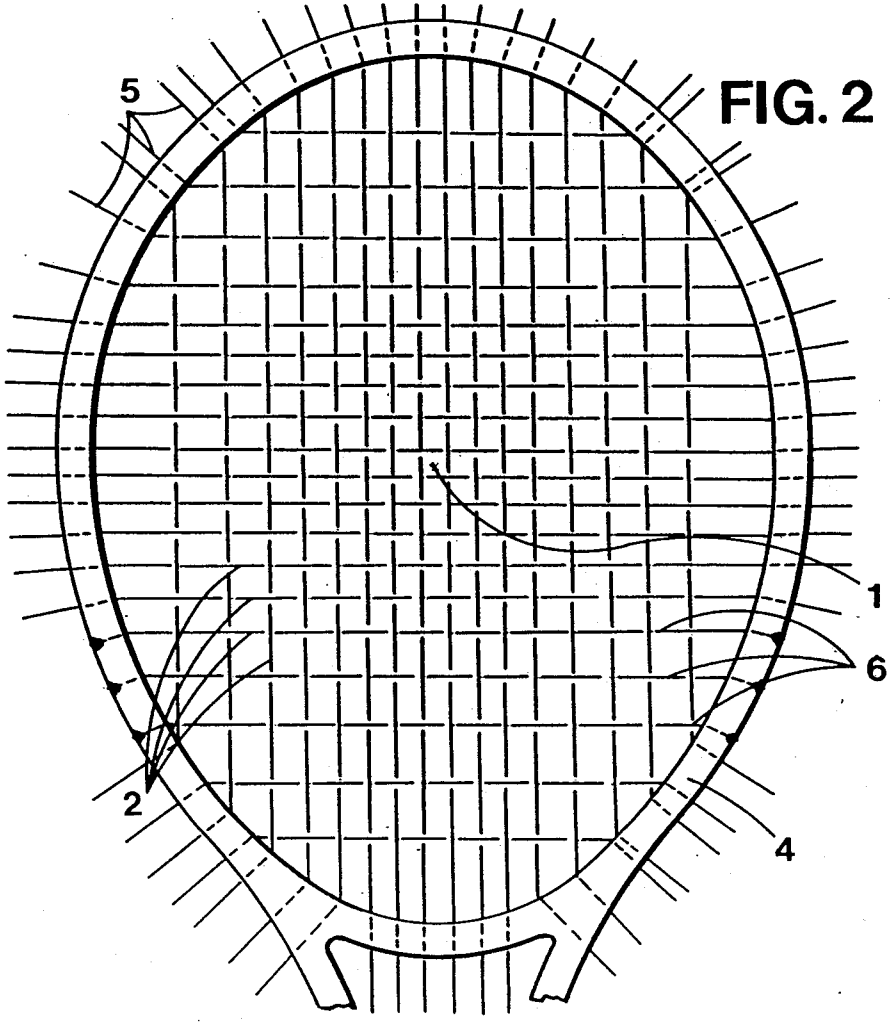
FIG. 2: the net placed on the frame of a racket at the beginning of the stringing process.

FIG. 2 represents the frame 4 of a tennis racket during stringing. The net of prewoven strings is placed on the frame; the ends 5 of the strings 2 extend beyond the frame and are used to tension and fix them. The strings 6 are already tensioned and attached.

The prewoven net 1 can be protected during shipping, storing, and application in several ways. For example, it can be placed between two sheets of plastic material which adhere to each other achieved by heat pressing, a vacuum packaging method, or by glueing using for example a self sticking foil. In this way the strings of the net retain their relative position. One could also fix the position of the strings of the net with a glue acting only temporarily.

Figure 3:
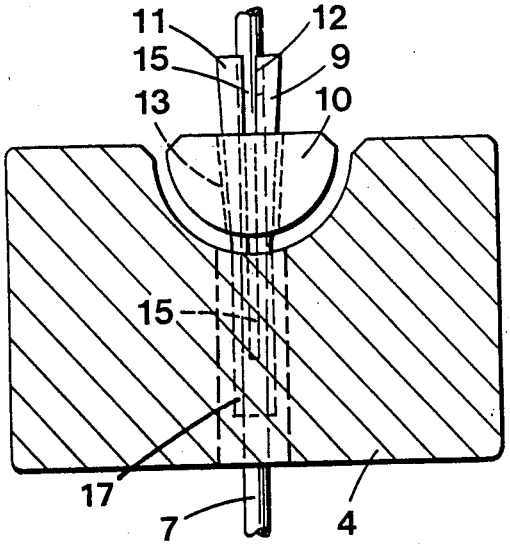
FIG. 3: the fixing device inserted into a profiled frame, in an open position.
Figure 4:
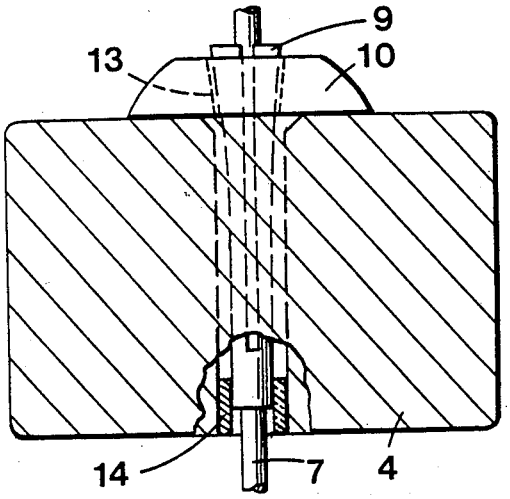
FIG. 4: the fixing device adapted to a straight frame, in a closed position.
Figure 5:
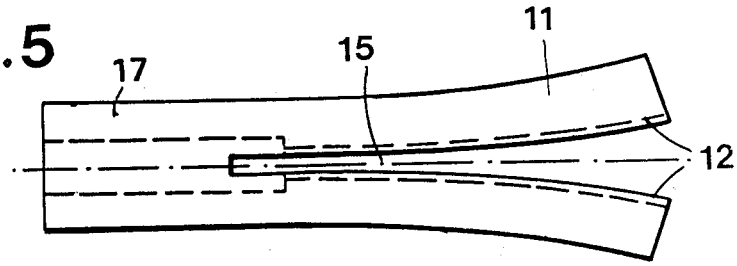
FIG. 5: details of the first piece 9 of the fixing device.

Examples of the fixing device are shown in FIGS. 3, 4, and 5. The device consists of a first piece 9 whose upper part 11 is formed of two conical half shells, separated from each other by the slot 15 and enclosing the string 7 at the time of stringing. The inner surface 12 of the half shells is threaded to increase the adherence of the string. The lower part 17 is a tube with an exterior diameter smaller than the hole of the frame and an interior diameter larger than the diameter of the string.

The piece 9 slides inside a second piece 10 whose outer form is adapted to the profile of the frame 4. The hole 13 is conical. During stringing, piece 9 is put inside piece 10 and the two put into a hole of the frame. The string is introduced through them from inside to the outside of the frame, then tensioned while keeping the fixing device in its position in the hole of the frame. As piece 9 is pushed into its clamping position, the external tension can be released and piece 9 is pulled further into the conical hole and acts like a jaw: The two half shells are pressed against the string as piece 9 is wedged into piece 10 and the desired tension is maintained.

When a string needs to be replaced, piece 9 is pushed from the inside of the frame towards the outside, the jaw opens, and the two pieces can be removed and used again.

The two pieces of the fixing device can be manufactured out of light metal, as for example aluminum, or out of synthetic material.

As an example, here are the dimensions of the two pieces of the fixing device, in its preferred embodiment manufactured in aluminum,:

| | | |
|---|---|---|
| Piece 9 | Length | 12 mm |
| | Lower diameter | |
| | inside | 2,0 mm |
| | outside | 3,0 mm |
| | Length of slot | 10 mm |
| | Width of slot | |
| | bottom | 0,5 mm |
| | top | 1,0 mm |
| | Diameter of the two half shells on top | 4 mm |
| | Diameter of the thread, with the two half-shells closed | 1,1 mm |
| Piece 10 | Width | 7 mm |
| | Length | 10 mm |

-continued

| | |
|---|---|
| Max. Thickness | 3 mm |
| Outer diameter of hole | 4 mm |
| Inner diameter of hole | 3,1 mm |

An annular piece 14 made of elastic material can be put over the lower end of piece 9 between it and the hole of the frame. This ring allows the fixing device to be left inserted in the hole of the frame which represents a significant advantage because rackets can be equipped with these devices in the factory and can be shipped without risk of losing them. In addition, this ring protects the string and the frame from wear at the lower end of piece 9 of the fixing device.

In order to string a tennis racket the net is placed on the frame and the string ends are individually introduced into the holes of the fixing devices which are maintained in contact with the frame. Each string is tensioned to the desired tension with the usual means and then held by the fixing devices. In this manner it is no longer necessary to interweave the strings during stringing and to pull the whole length of string (approx. 11 m) through each hole. For repairs one can change a single defective string without loss of any tension for the rest of the stringing. The time to string a racket is significantly reduced.

Furthermore, this method of stringing a racket can be adapted to an automated procedure.

What is claimed is:

1. A racket comprising:

a frame consisting of a handle portion and a head portion connected thereto, said head portion having a plurality of holes extending through said frame in essentially a radial direction for receiving strings, a prewoven grid of a predetermined number of individual strings having free ends which extend beyond the woven portion of said grid, further characterized in that said free ends extend through said holes whereby said grid defines said racket head; and a fixing means for the free ends of said individual strings comprising first and second members, said first member, tubular in shape, having an outer diameter smaller than the diameter of the hole of the frame of said racket and having a first lower portion extending through the interior of said frame hole having an inner diameter larger than the diameter of the string and having a second portion extending outwardly of said frame hole having a slot formed therein which separates the tubular second portion into two half shells, the exterior surface of which is conical and expanding toward the end of said first member extending outwardly of said racket frame and having an inner surface which is of a diameter smaller than the diameter of the string when the two half shells are pressed against each other, and said second member placed over said frame holes and located entirely exteriorly of said holes in said head portion, the exterior surface of said second member being adapted to the profile of the racket frame and comprising an inner conical opening expanding in the direction away from the frame;

whereby during stringing of said racket said first member is placed inside said second member and into a hole in said frame, the string being passed through the hole of said first member, the slotted part of which is oriented toward the exterior of said frame, whereby when said first member slides into said second member, its two half shells are pressed together around the string by the conical hole and thus hold the string in place when under tension.

2. The racket as defined in claim 1, wherein said first lower portion of said first member further includes a ring of elastic material inserted through the end of said frame hole interiorly of said racket frame to secure said fixing means in the hole even in the absence of a string.

3. A method for stringing a racket frame, said racket frame having a handle portion and a head portion connected thereto, said head portion having a plurality of holes extending through said frame in essentially a radial direction for receiving strings comprising obtaining a prewoven grid of predetermined number of individual strings having free ends which extend beyond the woven portion, said free ends being further characterized in that said ends are arranged for entry into the holes in said racket head, extending said free ends through said holes whereby said grid defines said racket head, securing said strings to said frame with a securing means, said securing means comprising first and second members, said first member having an outer diameter smaller than the diameter of the hole of the frame of said racket and having a first lower portion extending through the interior of said frame hole having an inner diameter larger than the diameter of the string and having a second portion extending outward of said frame hole having a slot formed therein which separates the second portion into two half shells, the exterior surface of which is conical and expanding toward the end of said first member extending outward of said racket frame and having an inner surface which is of a diameter smaller than the diameter of the string when the two half shells are pressed against each other, and placing said second member over said frame holes to thereby locate said second member entirely exteriorly of said holes in said head portion, the exterior surface of said second member being adapted to the profile of the racket frame and comprising a conical opening whose diameter increases in the direction away from the frame, placing said first member inside said second member and into the hole in said frame, placing said string through the hole of said first member, the slotted part of which is oriented toward the exterior of said frame, whereby when said first member slides into said second member, its two half shells are pressed together around the string by the conical hole and thus holding the string in place under tension.

4. A device for securing an independent string to a rigid frame, said frame having frame holes located therein for receiving string comprising a first member, tubular in shape, adapted to cooperate with a frame hole and having a first portion adapted to extend within a frame hole and having a second portion adapted to extend radially and exteriorly of said frame, said second portion having an outer end located away from said first portion and also having a slot formed therein which separates the tubular member into two half shells forming a conical surface which is laterally expandable near the outer end of said second portion and having an inner surface which is threaded and adapted to secure a string to be placed therethrough when the two half shells are pressed against each other, and a second member having a first face adapted to cooperate with the exterior surface of the frame and having a conically tapered hole located therethrough, said conically tapered hole expanding in a direction away from said first face, said second member having an outer peripheral surface that decreases in circumference in a direction away from said first face, whereby during stringing, said first member is placed inside said second member and into a frame hole, said string being passed through the interior hole of said first member, the slotted part of which is oriented radially exteriorly of the frame, and whereby as said first member slides into said second member, said two half shells of said first member are pressed together around the string by said conical hole to thus hold the string in place when under tension.

5. The device as claimed in claim 4, wherein said first portion of said first member further includes a ring of elastic material adapted to be inserted through the end of said frame hole interiorly of said racket frame and further adapted to secure said securing device in the hole even in the absence of a string.

6. A device for securing an independent string to a rigid frame, said frame having frame holes located therein for receiving strings comprising a first member, tubular in shape, adapted to cooperate with a frame hole and having a first portion adapted to extend within a frame hole and having a second portion adapted to extend radially and exteriorly of said frame, said second portion having an outer end located away from said first portion and also having a slot formed therein which separates the tubular member into two half shells forming a conical surface which is laterally expandable near the outer end of said second portion and having an inner surface which is threaded and adapted to secure a string to be placed therethrough when the two half shells are pressed against each other, and a second member having a first face adapted to cooperate with the exterior surface of the frame and having a conically tapered hole located therethrough, said conically tapered hole expanding in a direction away from said first face, said second member having an outer peripheral surfaces that decreases in circumference in a direction away from said first face, whereby during stringing, said first member is placed inside said second member and into a frame hole, said string being passed through the interior hole of said first member, the slotted part of which is oriented radially exteriorly of the frame, and whereby as said first member slides into said second member, said two half shells of said first member are pressed together around the string by said conical opening to thus hold the string in place when under tension, wherein said first portion of said first member further includes a ring of elastic material adapted to insert through the end of said frame hole interiorly of said racket frame and further adapted to secure said securing device in the hole even in the absence of a string.

* * * * *